US005487320A

United States Patent [19]

De Mowbray

[11] Patent Number: 5,487,320

[45] Date of Patent: Jan. 30, 1996

[54] DRUM AND DRUM GAUGE

[76] Inventor: Marcus De Mowbray, 106 Douglas Flats, Marshalsea Road, London SE1 1JW, England

[21] Appl. No.: 31,759

[22] Filed: Mar. 15, 1993

[51] Int. Cl.[6] ..... G10D 13/02

[52] U.S. Cl. ..... 84/413; 84/419

[58] Field of Search ..... 84/413, 419, 411 R

[56] References Cited

U.S. PATENT DOCUMENTS

| | | | |
|---|---|---|---|
| 3,163,075 | 12/1964 | Toperzer, Jr. | 84/419 |
| 3,163,076 | 12/1964 | White | 84/419 |
| 3,747,463 | 7/1973 | Hinger | 84/419 |
| 4,056,998 | 11/1977 | Rampton | 84/419 |
| 4,278,003 | 7/1981 | Hanson | 84/411 A |

FOREIGN PATENT DOCUMENTS 2193593 2/1988 United Kingdom .

*Primary Examiner*—Patrick J. Stanzione
*Attorney, Agent, or Firm*—Stroock & Stroock & Lavan

[57] ABSTRACT

A drum and drum gauge have a head supported on a cylindrical shell which is open at its bottom and provided with tensioning bolts for tensioning the head to tune the drum. The drum shell is detachably connected to a stand. The stand can be easily folded to a closed position for ease of transport. The tuning part of the drum comprises a plurality of arms extending substantially horizontally and radially from a tension bolt at one end, through a bushing in the shell, to a central operating rod at the other. Upward movement of the central rod moves the tension bolts downwards, with a lever action, increasing the tension of the drum head. The lower end of the central rod is attached to a foot lever pivotable about a horizontal access and carrying a pedal for applying a brake. A gauge for indicating the drum's pitch has a fixed scale and a movable indicator coupled to the foot lever by a sheathed cable. Alternatively, the gauge has a fixed indicator and a scale pivotally fixed to the drum shell coupled to the foot lever by a rigid rod.

22 Claims, 11 Drawing Sheets

72
75
74
73
71
G
F
E
D
C
B
A
70
79
80
78
81
72
62
65
66
64
44
44
67
73
76
77
42
35
46
47
42

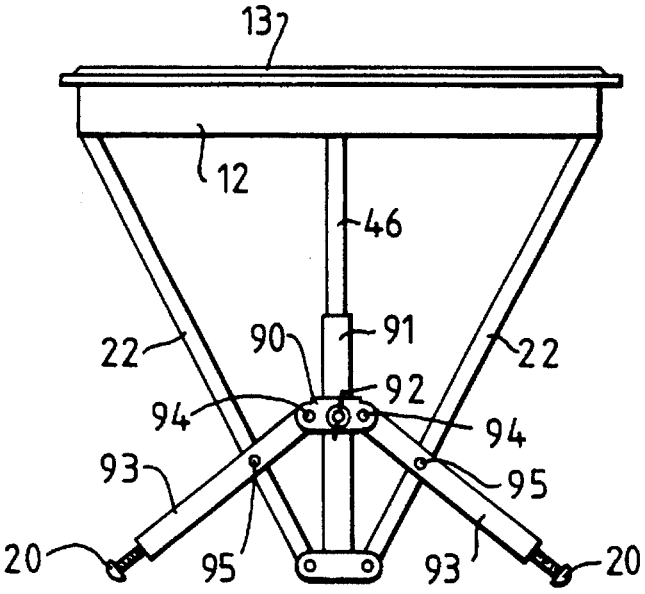
FIG. 9
FIG. 10
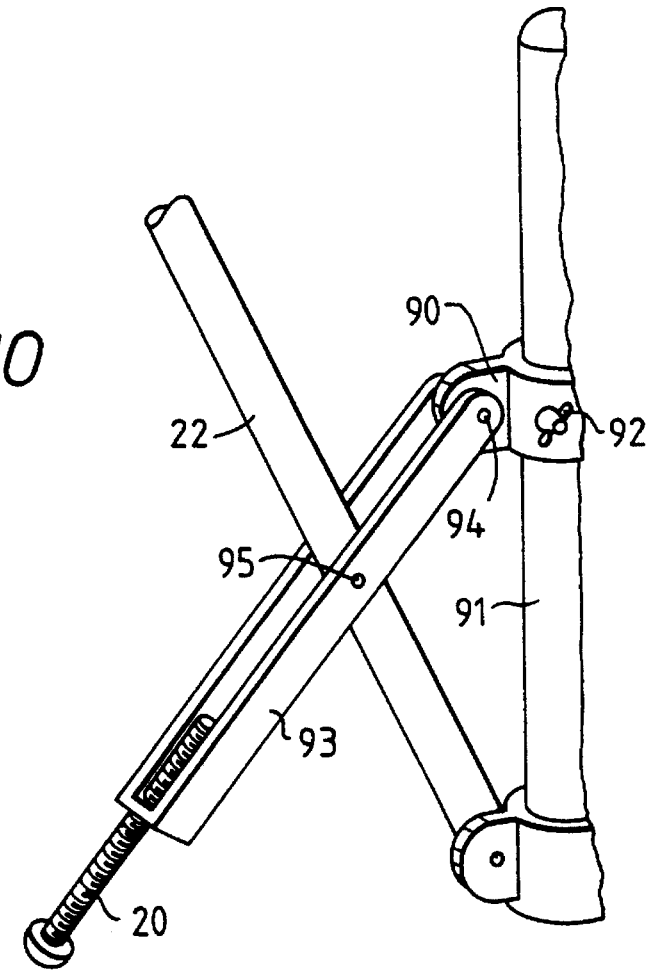

DRUM AND DRUM GAUGE

BACKGROUND OF THE INVENTION

This invention relates to a drum and drum gauge.

Timpani type drums, such as kettle drums, have a single head and a shell depending downwardly therefrom, and tuning means for adjusting the tension of the head to adjust the pitch of the drum. The shell is usually a large bowl shaped resonator. The tuning comprises a plurality, normally eight, of tension bolts evenly spaced around the perimeter of the head where the head and shell are connected via a hoop. While the tension bolts may be individually adjustable by individual screwing, they are preferably connected to a common adjustment activating member which is connected to each of the tension bolts to adjust them all simultaenously and evenly.

For many pieces of music the tuning adjustment has to be made very rapidly (within a few seconds) while a piece is being played. For this reason, a foot controlled pedal is provided for achieving the adjustment through a common adjustment member. A gauge is connected to the common adjustment member/foot pedal to indicate when the correct tuning has been achieved. For example, the drum may be tuned to any of the notes in an octave and the gauge will have an indicator which moves across a scale marked A, B, C, D, E, F, G and with the sharps and flats if desired.

PRIOR ART

Conventional kettle drums of any substantial head diameter are both large, heavy and cumbersome to move. A conventional kettle drum of 81 cms diameter will weigh about 100 KG. In order to support the drum at the correct height, the drum shell is normally supported on a stand which is permanently fixed thereto. While stands for timpani type drums are known having telescopically retractable legs, as far as is known, no kettle drum is at present available which includes a foot pedal operated tuning adjustment and which can be easily dismantled, transported and re-assembled.

GB Specification 2193593 shows a double headed drum of small size, detachably mounted with the drum axis substantially horizontal on a stand. Tuning straps extend outside the drum shell and tuning adjustment is by constricting the straps towards one another.

U.S. Pat. No. 4,278,003 shows a Rototom type drum with no shell, in which tuning action is by relative rotation of two die castings connected to the drum head.

Conventionally, a foot pedal control for adjusting the tension bolts has been linked by eight separate pull rods to the bolts so that eight pull rods extend from adjacent the ground around the shell to the tension bolts, with the movement of the foot pedal exerting a pull simultaneously on each of the eight rods. A brake, clutch or other lock member is required to retain the pull rods in the selected position once adjustment has been made. The force required on the pull rods and thus on the pedal is considerable since no gearing is built in and this means that not only is considerable force required on the foot pedal to move it making it difficult to achieve exactly the required adjustment but the brake/lock device has to be strong to retain the foot pedal in the selected position.

Conventional drum gauges are permanently attached to the upper part of the side of the drum shell and a linkage of non-flexible rods connects the foot pedal with a pivotally mounted pointer arranged to move over an arcuate scale. The bearing between the linkage and the pointer usually develops sufficient play that the system once calibrated has an error of a semitone between movement in one direction and the other direction. The system needs re-calibration each time the drum is packed and set up again. When several drums are being played by a single player it is difficult to position the drums so that each of the gauges is easily visible.

SUMMARY OF THE INVENTION

An object of this invention, in one aspect, is to provide a drum which can be more easily transported. Such a drum can be dismantled into a number of parts and easily reassembled.

Accordingly, in one aspect, the invention provides a drum having a head, a cylindrical shell open at its bottom, a stand which is movable between a folded relatively flat condition and an erect three dimensional support position in which it is adapted to be connected to and support the shell and head, fastening means for attaching and detaching the stand to and from the shell, foot operated tuning means having an upper part fixed to the shell and a lower part fixed to the stand, and coupling means for coupling the tuning parts together in the erect condition of the stand such that movement of the lower part will adjust the tuning of the head. The shell preferably has a depth no more than 70 cms and with advantage no more than 50 cms.

With such an arrangement, the head/shell can be dismantled into a single piece having a depth of no more than 50 to 70 cms so that with a head diameter of 81 cms the whole weight is no more than 20 KG and the stand/foot pedal can be folded to a size of no more than 100×100×20 cms. The whole drum can be located in the back of a standard estate car and carried without strain by a single person. With a conventional kettle drum of this size, a transit van is required and at least two people to handle the drum.

Although the cylindrical shell design produces a slightly different tone from a conventional instrument it is none the less suitable for a variety of situations where ease of transport and storage and lower cost make it preferable to a conventional pedal timpani.

Another object of the present invention, in another aspect, is to provide a lever operated system for connecting a foot pedal to the tension bolts so that the adjustment force required on the foot pedal is reduced. Preferably the timpani type drum of the invention includes a tuning system operating with a lever action having a mechanical advantage of at least ten. This makes adjustment easier and requires a simpler lock mechanism for retaining the system in the adjusted position.

In another aspect the invention provides a drum having a head, tension bolts for tensioning the head, a shell supporting the head end open at its bottom, a foot operated tuning means for tuning the head via the tension bolts, in which the tuning means comprises a plurality of substantially radially extending arms located within the depth of the shell, the arms having their outer ends effectively connected to respective ones of the tension bolts and their inner ends adjacent one another and arranged to be operated on by a common operating rod substantially on the drum axis, the arrangement being such that movement of the central rod upwards moves the tension bolts downwards by a lever action to increase the tension on the drum head.

With advantage, a foot pedal is connected to the lower end of the central rod via a lever member which is pivotable about a horizontal axis, which movement is preferably guided by an upright arcuate guide member.

A brake/lock means comprises a spring loaded pad biased to engage the guide member and resist movement of the lever member until the pedal is depressed. Depression of the pedal first disengages the brake/lock movement of the lever after which movement of the lever causes the adjustment of the tuning.

The lever arrangement produces a considerable mechanical advantage (greater than ten and preferably greater than a hundred) so that movement of the pedal to produce the tuning requires little mechanical force and the brake/lock has little mechanical tension to resist. The brake can thus be a simple spring loaded pad engaging with a fixed member.

Preferably, the arms, lever and rods are all made from standard rod or tube parts and thus no expensive engineering is required.

Another object of the invention, in another aspect, is to provide a simpler, more versatile gauge which needs less re-calibrating.

Accordingly, in another aspect, the invention provides a gauge which comprises an indicating device attached by a length of flexible sheathed cable to the tuning mechanism to move therewith. The fixed length sheath is connected between the indicator body which carries a scale and a fixed part of the stand; one end of the cable is movable over a, preferably linear, scale on the indicating device to act as the indicator with the other end of the cable being attached to the tuning lever carrying the pedal.

In another aspect, the invention provides a gauge which is not permanently fixed to the drum but is provided with detachable attachment means e.g. a Velcro (RTM) pad or magnet, for connection to the head or shell at any position around the perimeter or to a music stand.

By using a simple sheathed cable, the construction of the gauge is cheaper and needs less re-calibration and as the cable is flexible the gauge can be placed in the most convenient position for any particular use.

In a further aspect the invention provides a gauge for indicating how a drum is tuned comprising a scale member, pivotable mounting means for mounting the scale member to a drum, so that the scale can move against a fixed indicator, a rigid rod, and a substantially universal connection joint at each end of the rod for detachably connecting the rod between a movable tuning member of a drum and the scale member.

BRIEF DESCRIPTION OF THE DRAWINGS

While the invention has several aspects, which may be claimed separately or combined, preferred embodiments will now be described, by way of example only, reference being made to the diagrammatic accompanying drawings (not to scale and with some parts omitted or sectioned in some views) of which:

FIG. 9 is a front view of the stand of FIG. 8, FIG. 10 is a perspective view of a detail (on an enlarged scale) of part of the stand of FIGS. 8 and 9.

DETAILED DESCRIPTION OF EMBODIMENTS OF THE INVENTION

Figure 1:
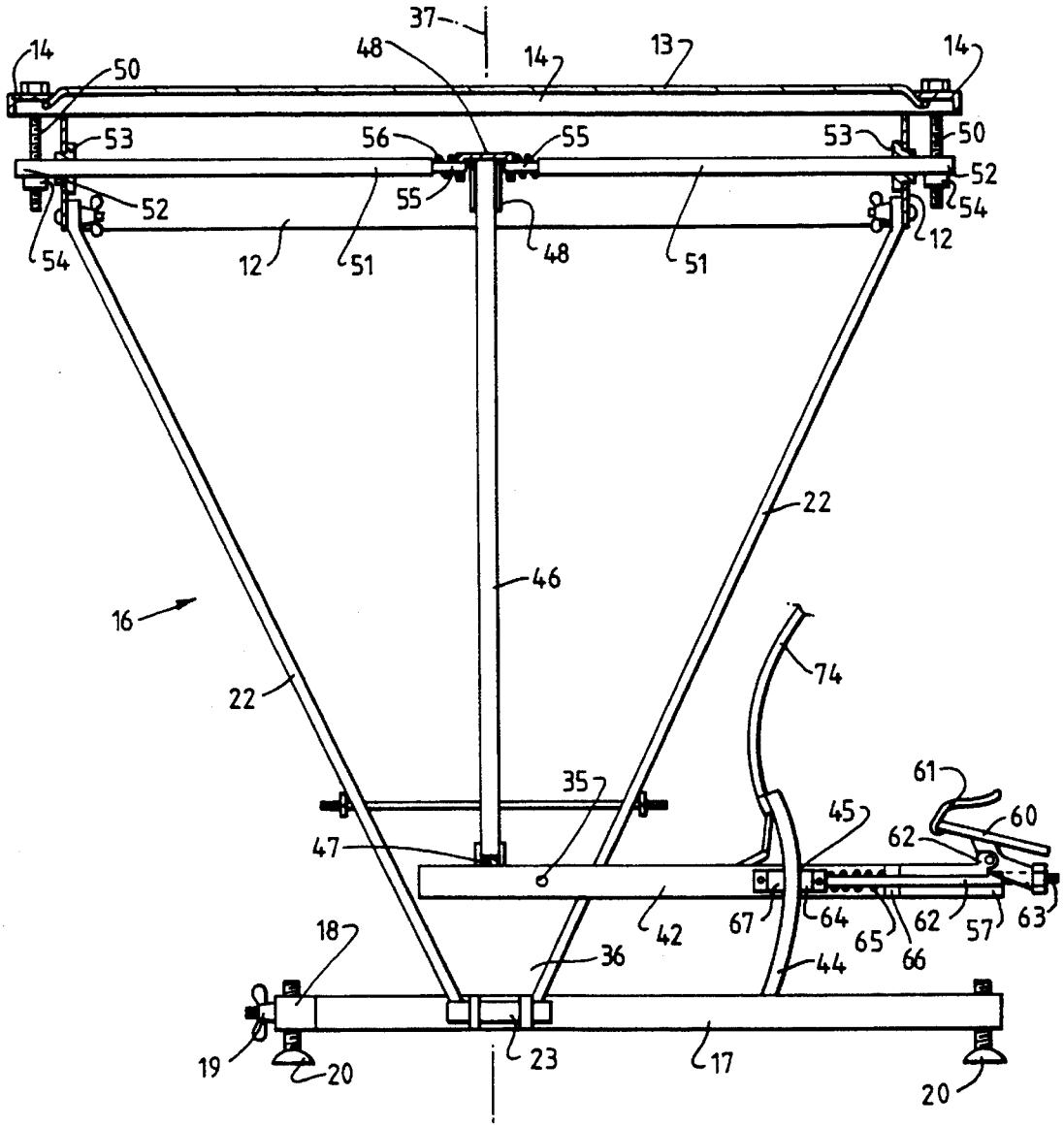
FIG. 1 is a vertical axial sectional view of the drum.
Figure 2:
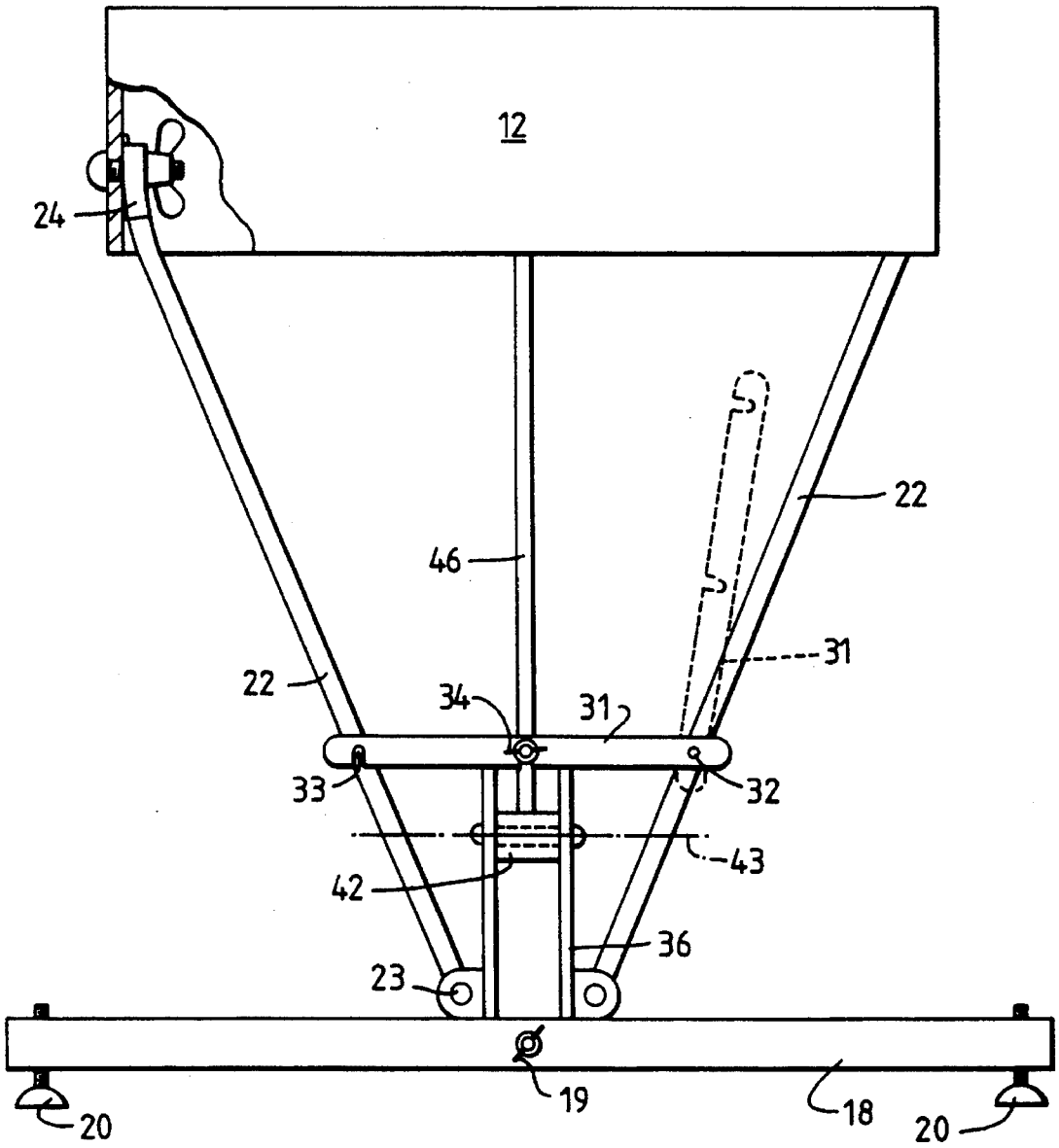
FIG. 2 is a side view taken at right angles to the FIG. 1 section.
Figure 3:
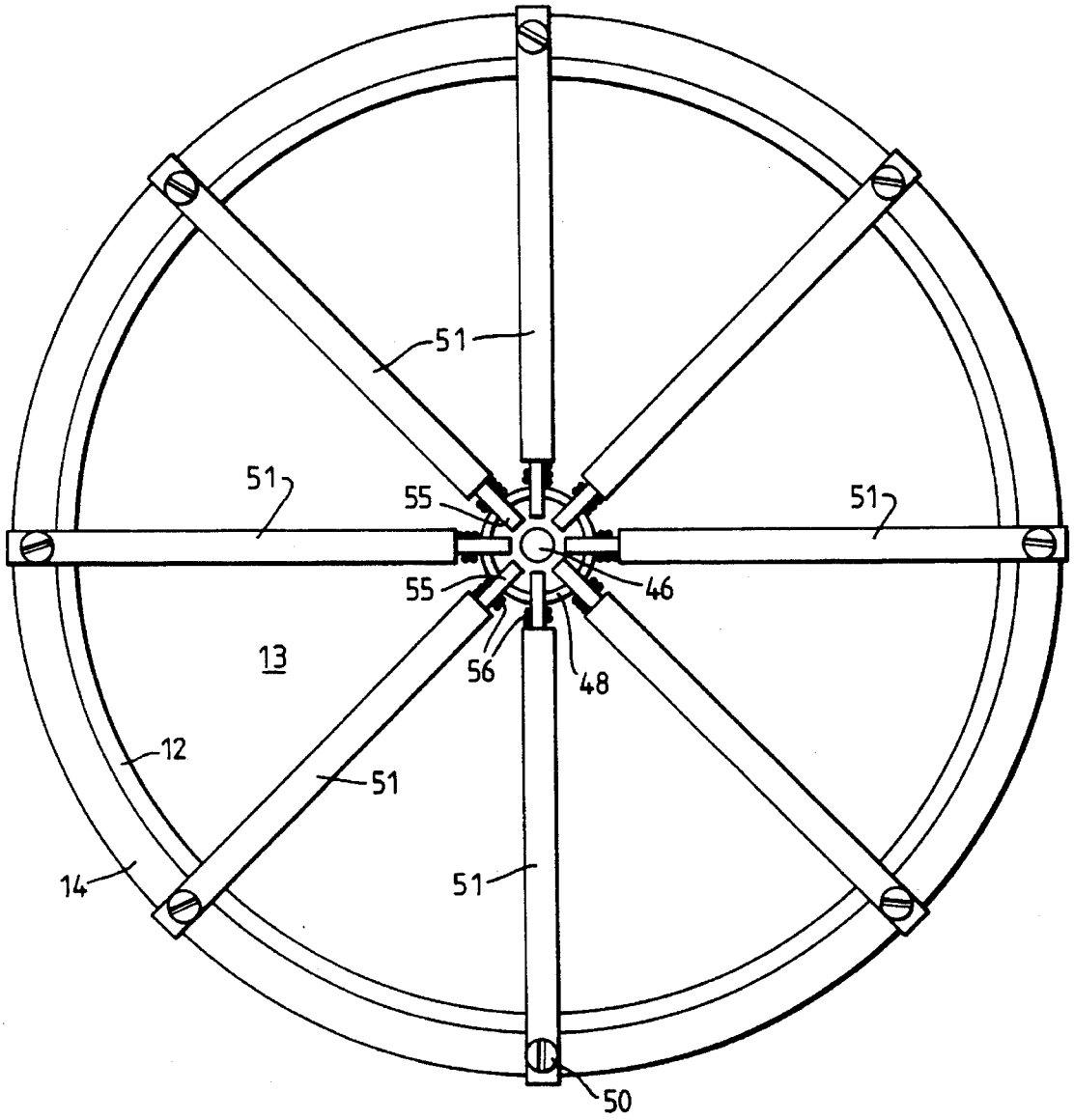
FIG. 3 is a plan view of the upper part of the tuning mechanism.
Figure 4:
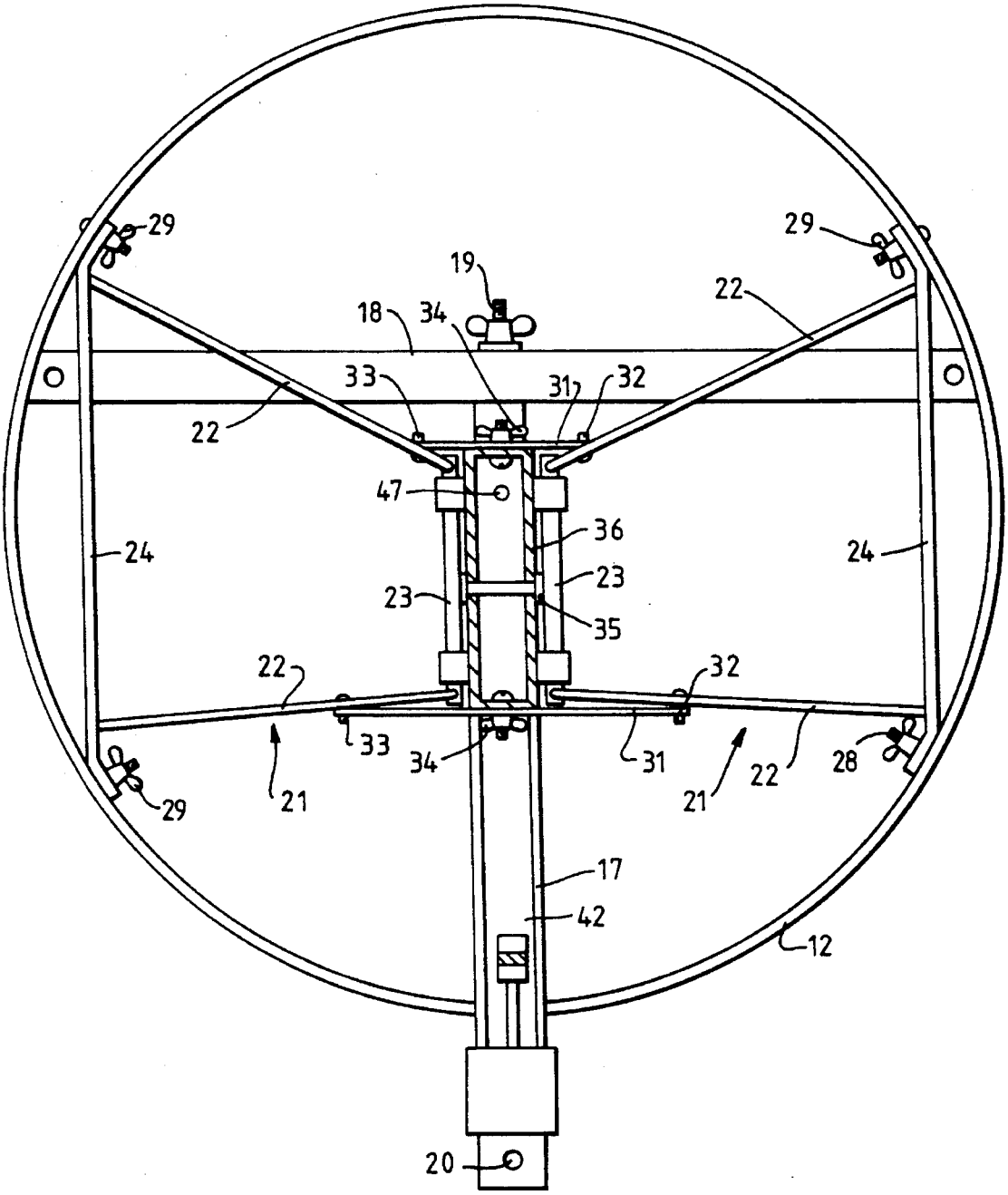
FIG. 4 is a plan view of the stand and lower part of the tuning mechanism.
Figure 5:
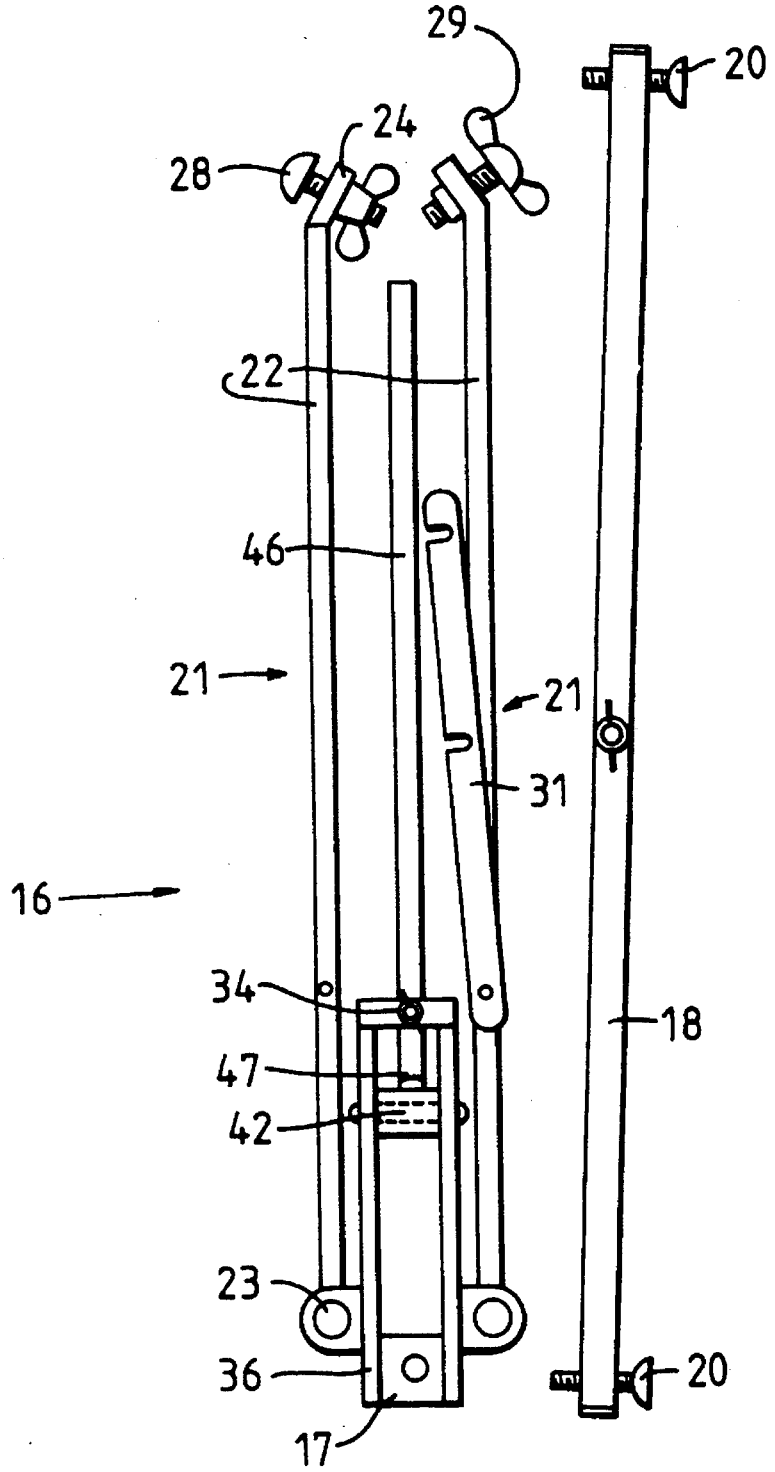
FIG. 5 is a side view of the stand in its folded condition.

The drum comprises a shallow cylindrical steel shell 12 made to the appropriate diameter to accommodate one of the conventional sizes of drum head 13 having its perimeter attached to a standard tuning hoop 14. The shell thus extends downwardly from the head and has an open bottom. The shell 12 is detachably supported on a foldable stand 16, foldable between an erect support condition seen in FIGS. 1 to 4 and a folded condition seen in FIG. 5. The stand 16 comprises two elongate base supports 17, 18, detachably connected by a screw and nut 19, to extend at right angles to one another in a T-formation in the support position. Each support preferably has adjustable height feet 20. The stand has a pair of upwardly extending roughly trapezium shaped sides 21 formed from upright rods 22, base pivoting spindles 23 and upper bars 24. The sides 21 are pivotally attached to the support 17 so that they can pivot about horizontal axes between the support position, at an angle of less than 90° to one another, and a folded position substantially vertical, relatively flat, and adjacent one another.

Figure 6:
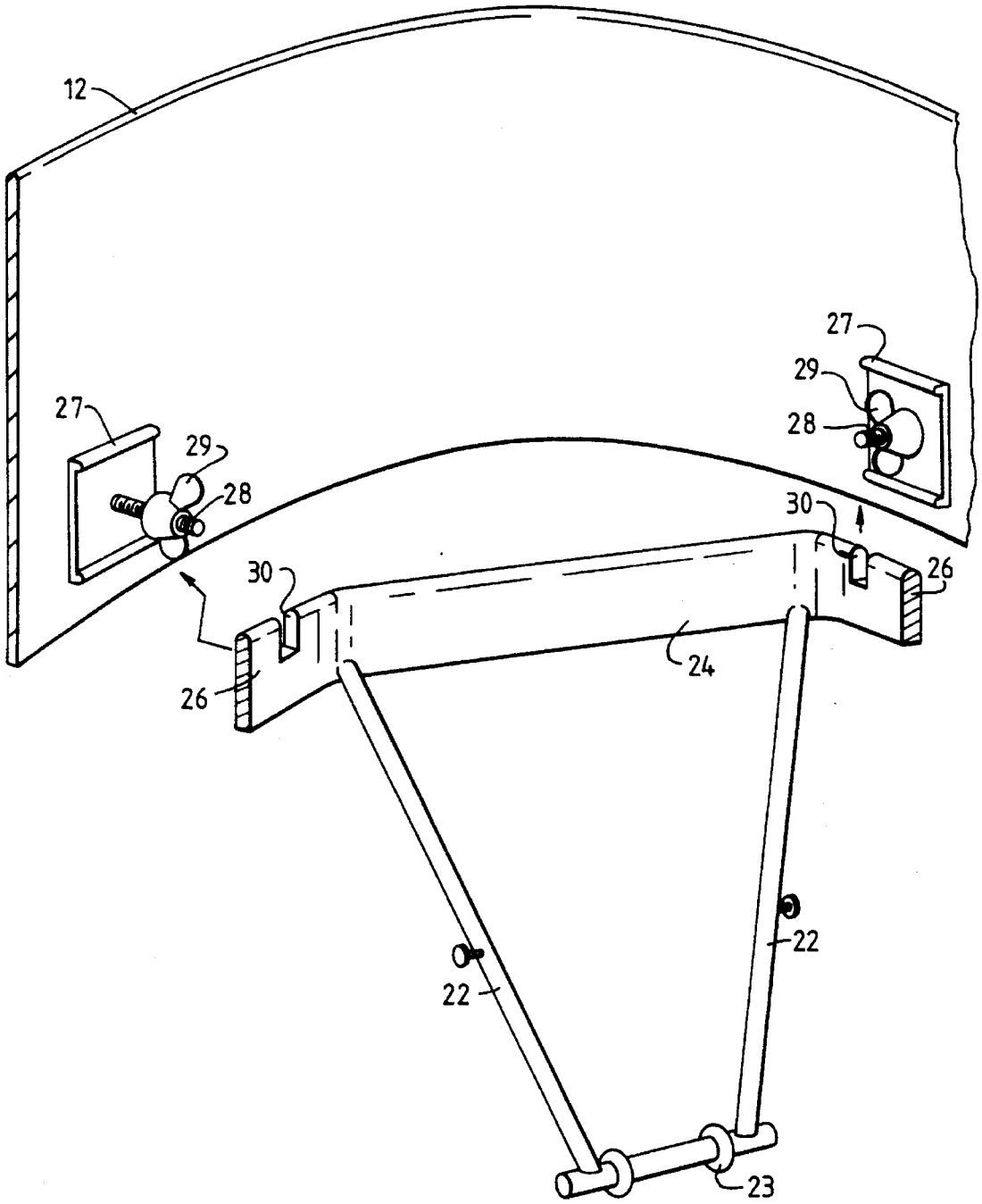
FIG. 6 is an enlarged detailed view showing the connection of the stand and shell.

As best seen in FIG. 6, the upper bars 24 are shaped and have ends 26 which are received in brackets 27 welded to the inner surfaces of the shell and secured in the brackets by screws 28 and nuts 29 engaging in slots 30 in the ends 26. The upper and lower edges of the brackets hold the shell securely to the stand even under the high tension imposed by the tuning system. The sides 21 are held apart in the support position by struts 31 pivoted at 32 to one side, engaging with pins 33 on the other side, and retained by nuts 34 on a central upwardly extending chassis 36 on the support 17. The chassis 36 is located under the vertical, central axis 37 of the drum.

A substantially horizontally extending lever 42 is pivotally mounted by pin 35 in the chassis 36 to pivot about a horizontal axis 43 of pin 35. An arcuate guide member 44 curved about this axis extends upwardly from the support 17 and is received in a slot 45 in the lever 42.

A tuning system has an upper part fixed to the shell and tension bolts on the head, a lower part (including the lever 42) fixed to the stand 16 and a rigid coupling rod 46 extending vertically on the axis 37. The lower end of rod 46 engages a bearing 47 on the upper surface of the lever 42 and the upper end of rod 46 is received in a bearing in a hub 48 forming part of the upper part of the tuning system. Rod 46 is removable both from the hub and the bearing and thus comprises a detachable coupling member for the tuning system.

The hoop 14 carries eight tension bolts 50, of conventional form, equiangularly spaced around its perimeter so that in known fashion downward movement of the bolts increases the tension on the head to increase the pitch of the drum. A movement of about 3 millimeters in the bolts is sufficient to adjust the pitch through an octave but this movement involves a considerable pull on the tension bolts. The bolts are located outside the shell. A plurality of substantially horizontal, radially extending arms or levers 51, one for each tension bolt, are arranged equiangularly in spider fashion within the depth of the shell. Each lever 51 is effectively pivoted in the shell adjacent its outer end 52 where it passes through a plastics bush 53 in the shell and its outer end is drilled to receive the lower end of a tension bolt 50, retained by a nut 54. The inner end 55 of each lever 51 is of reduced diameter and is received loosely through a hole in the hub 48. The holes are sufficiently large to allow relative pivotal movement between the hub and the levers and a spring 56 is located on each reduced diameter portion to reduce rattle and provide even pressure on all the levers.

It will be seen that downward movement of the free end 57 of the lever 42 causes upward movement of the coupling rod 46 and thus the hub and inner ends of all the levers 51. In response, outer ends of the levers all move down simultaneously, thus pulling down the tension bolts 50 and increasing the tension on the head. This lever action has considerable mechanical advantage due to the relative distances of the inner and outer ends of the levers from their fulcrums (bushes 53). Upward movement of the outer end 57 of lever 42 likewise lowers the pitch of the drum.

A foot operated member or pedal 60 having a toe cap 61 is pivotally mounted at 62 at the free end 57 of the lever 42 and is attached to a brake operating rod 63 extending within the lever 42. The rod carries a brake pad 64 which is biased into engagement with the guide 44 by a spring 65 located against a stop member 66. A fixed brake pad 67 also engages the guide 44. Depression of the foot pedal 60 about its pivot 62 acts to pull the brake rod away from the guide 44 thus releasing the brake and allowing movement of the lever 42 to adjust the tuning. Release of the pedal allows the spring to reactivate the brake to lock the lever 42 in the required adjusted position. Because of the mechanical advantage of the lever system, although the force on the tension bolts may be considerable, the force required by the brake is much less allowing a simple brake/locking system to be used.

Figure 7:
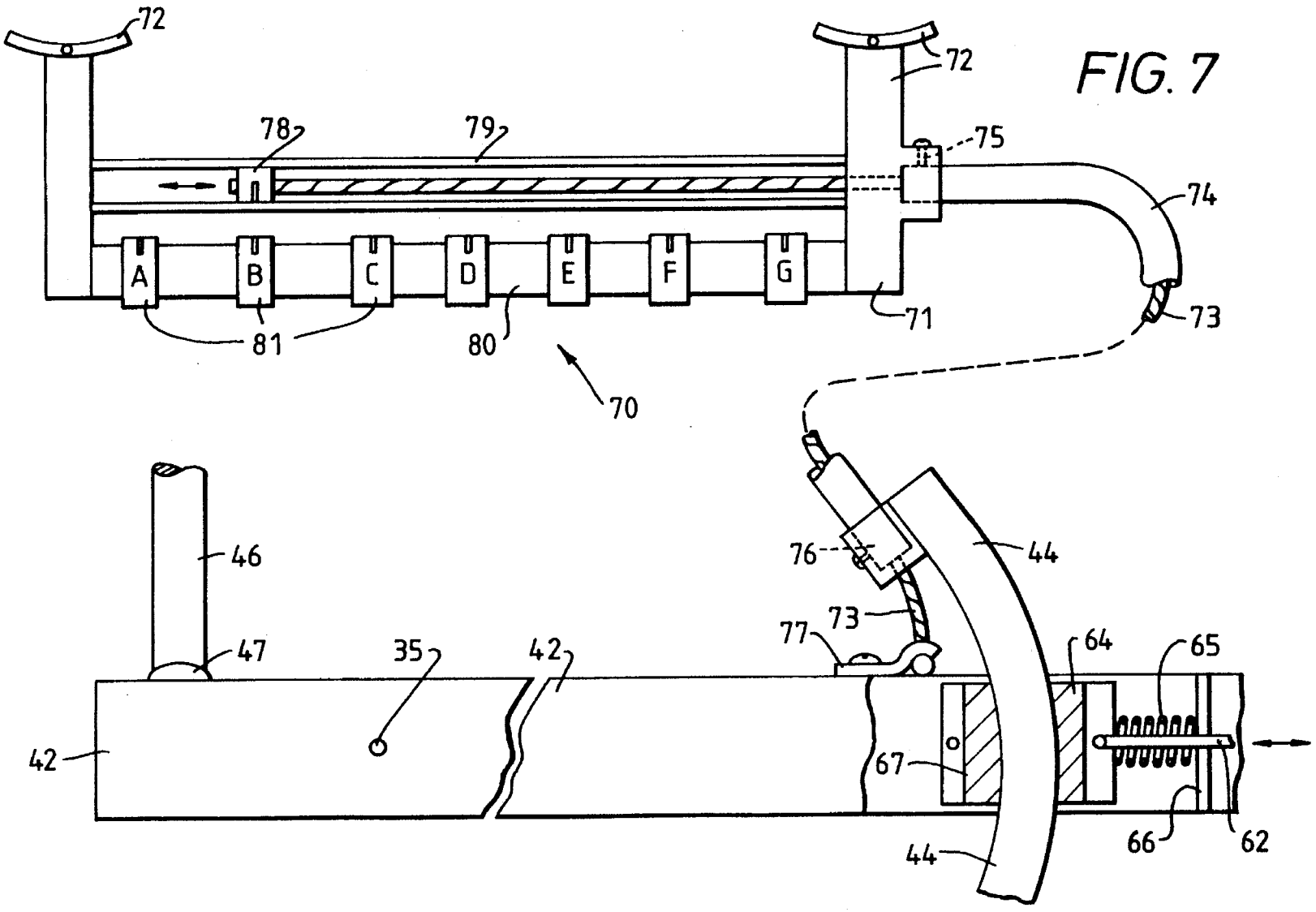
FIG. 7 is a view of one embodiment of drum gauge on an enlarged scale.

A tuning gauge 70 is provided to display to the player what pitch the instrument is producing at any given setting within the range of the tuning mechanism. The tuning gauge is operated by a simple sheathed cable. As seen in FIG. 7, the tuning gauge has a body 71 with pivotable feet 72 having detachable attachment means such as a Velcro (RTM) strip or magnetic or other clamping means for attachment to the drum or a music stand, at any chosen position. The gauge is connected to the foldable drum stand 16 only by a flexible sheathed cable 73, one end of the sheath 74 of which is fixed to the gauge body at 75 and the other end to the guide 44 at 76. The cable is slidable in the sheath and has one end fixed to the lever 42 by fastening 77 and the other end fixed to an indicator 78 slidable in a linear channel 79 in the body 71. A bar 80 extending parallel to and adjacent the channel 79, carries a series of markers 81 which are respectively marked A, B, C, D, E, F, G and are movable along the bar for calibration purposes but are normally retained thereon in a fixed position. It will be seen that movement of the lever 42 will move the indicator 78 relative to the markers. Before use, the tuning gauge will be calibrated, for instance using a well tuned piano for comparison, with the markers being positioned at the appropriate positions opposite the indicator. This gauge has the advantage that it is simple and once calibrated it will remain set even though it is detached from the drum for transport purposes (as long as the tension bolts are not adjusted except by the tuning mechanism). Because of the flexibility of the cable and the detachable attachment means on the feet, the gauge can be mounted at any suitable position in the required line of sight of the player.

Dismantling of the drum is easily achieved by first detaching the tuning gauge 70 from wherever it has been placed while leaving the other end still attached to the stand assembly. The nuts 29 holding the shell assembly to the stand assembly can be loosened enabling the entire shell assembly to be removed from the stand assembly. The nuts holding the struts 31 on the legs are loosened and the struts swung away so that the two sides of the stand can be folded together flat against one another. The support 18 is disconnected from the support 17 and the stand will then be of approximately 10 cms width. If desired, the stand and shell assembly can be packed side by side in a case.

Figure 8:
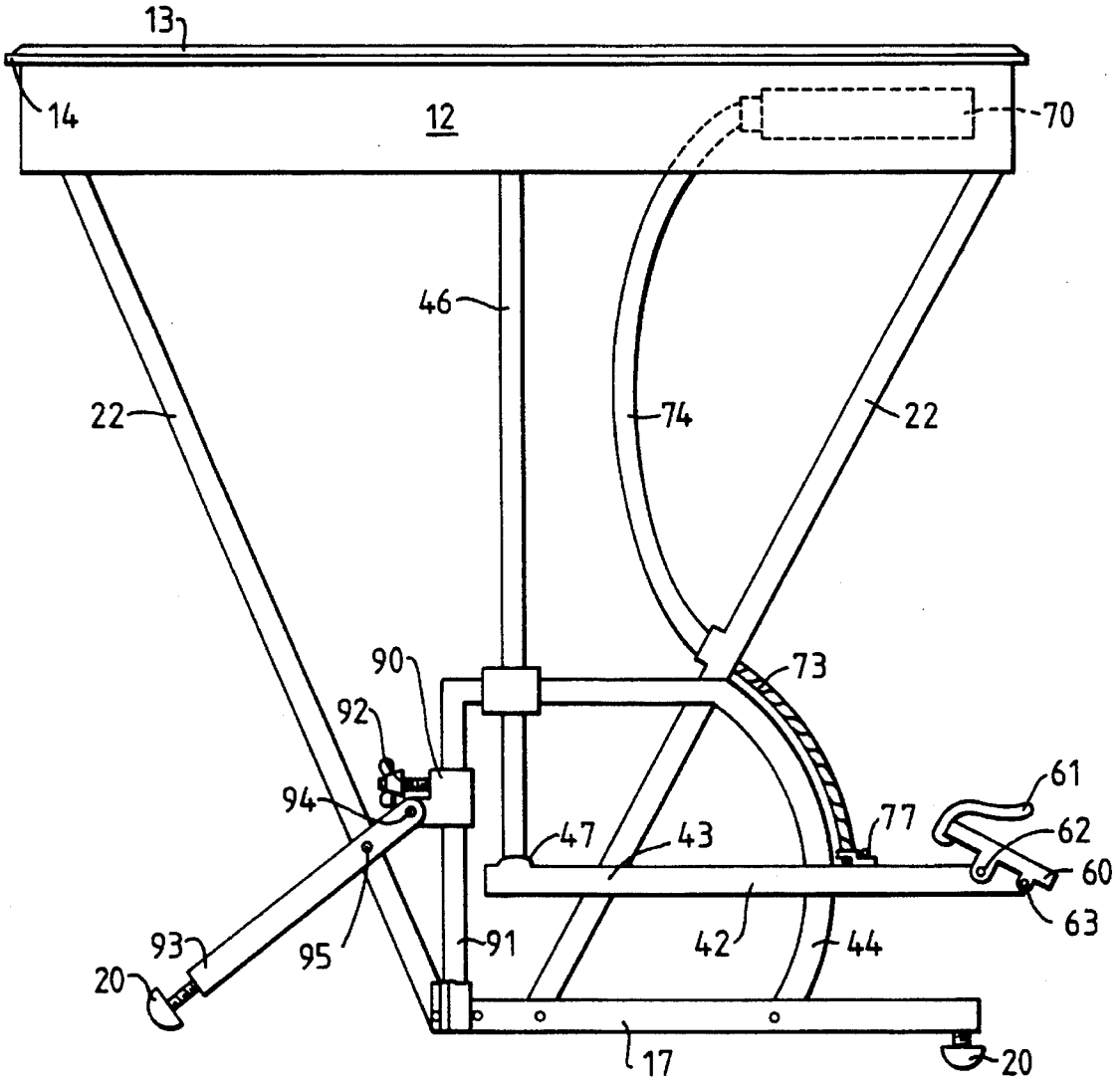
FIG. 8 is a side view of another embodiment of stand for the drum.

FIGS. 8, 9 and 10 show a modified form of stand where the same parts have been given the same reference numerals and will not be redescribed. In this arrangement the support 18 and struts 31 are omitted.

A retaining block 90 is slidably mounted on an upright chassis post 91 extending upwardly from the support 17. The block 90 includes a clamping screw 92 by which it can be clamped to the chassis post in a required position. A pair of legs 93, with adjustable feet 20, have their upper ends pivotally attached to the retaining block by pivots 94 at opposite sides of the block. Intermediate parts of the legs 93 are pivotally attached at 95 to respective rods 22. The legs 93, rods 22 and retaining block form a symmetrical parallel linkage air,out the central plane of the drum such that movement of the block up the chassis post causes the sides 21 to fold together and the legs 93 to fold together while movement down causes them to open out to the erect position shown.

Figure 11:
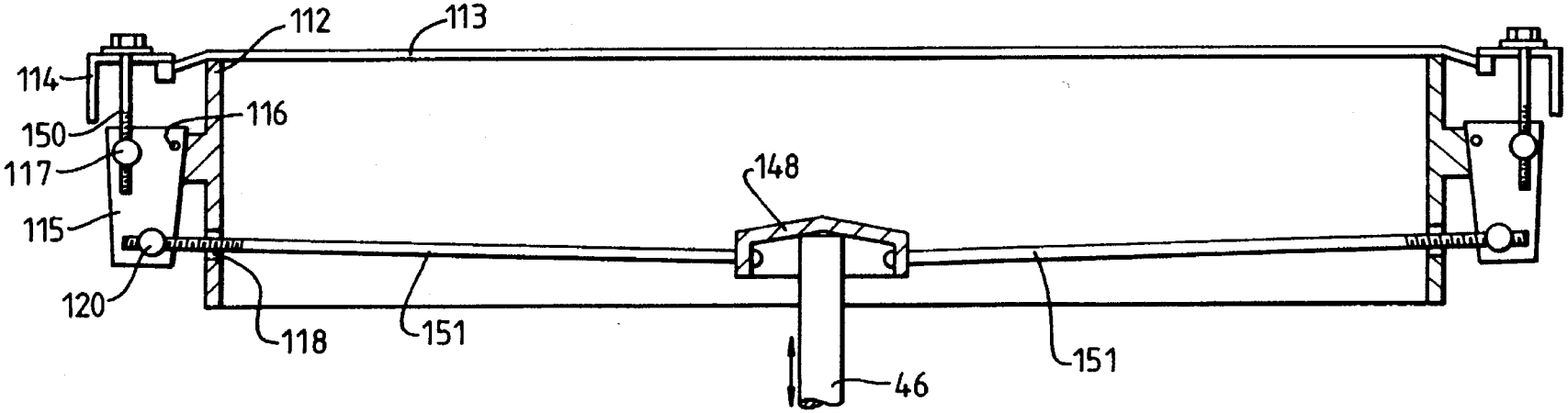
FIG. 11 shows a section through the drum head and shell with a modified upper part of the tuning system, in a relatively untensioned condition.
Figure 12:
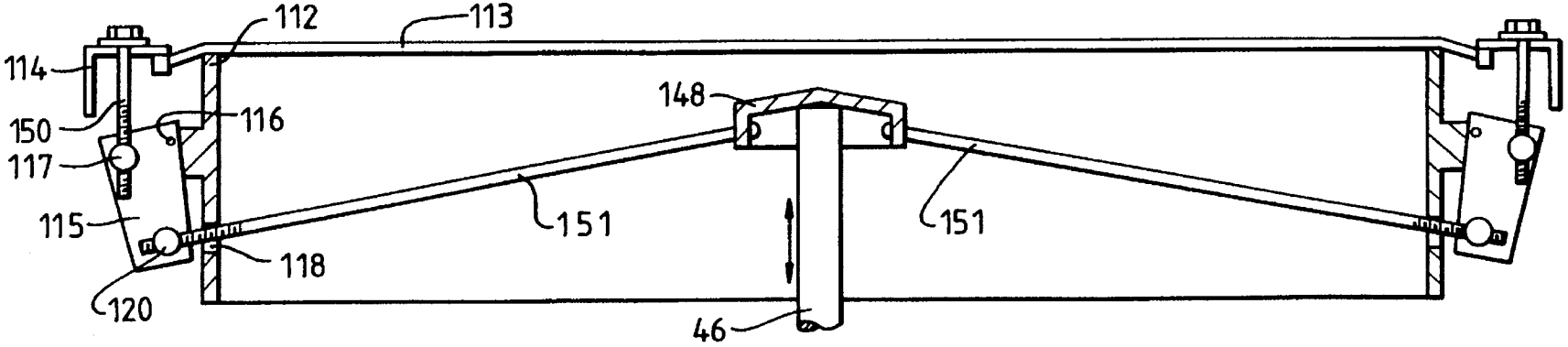
FIG. 12 shows the tuning system of FIG. 11 in a relatively tensioned condition.

The modified drum upper part shown in FIGS. 11 and 12 comprises a shell 112 supporting a head 113 having a tuning hoop 114 with eight tension bolts 150 as in the previous embodiment. For each tension bolt 150, a downwardly elongate bracket 115 has one of its upper corners connected at 116 to the outside of the shell for pivotal movement about a horizontal, substantially tangential axis. The lower end of the associated tension bolt is connected to the upper part of the bracket by a pivotting nut connection 117 spaced from the pivot 116. A plurality of lever arms 151, one for each tension bolt, are arranged equiangularly, substantially horizontally within the shell in a manner similar to the arms 51. Each of the arms 151 has its inner end located in a hub 148 and has its outer end extending through a gap 118 in the shell and being connected to the lower portion of a respective one of the brackets 115 at a pivotting nut connection 120. The outer end of each rod 151 is threaded and passes through a threaded part of the connection 120 so that an initial adjustment can be made to the effective rod length to ensure equal tension on each bolt 150. The central coupling rod 46 acts on the hub 148, as in the other embodiments, so that upward movement of the rod causes upward movement of the inner ends of the arms 151, causing pivoting of the brackets 125 about their axes 116 and applying a downward pull to the tension bolts 150. This movement involves a lever action with considerable mechanical advantage, greater than ten.

Figure 13:
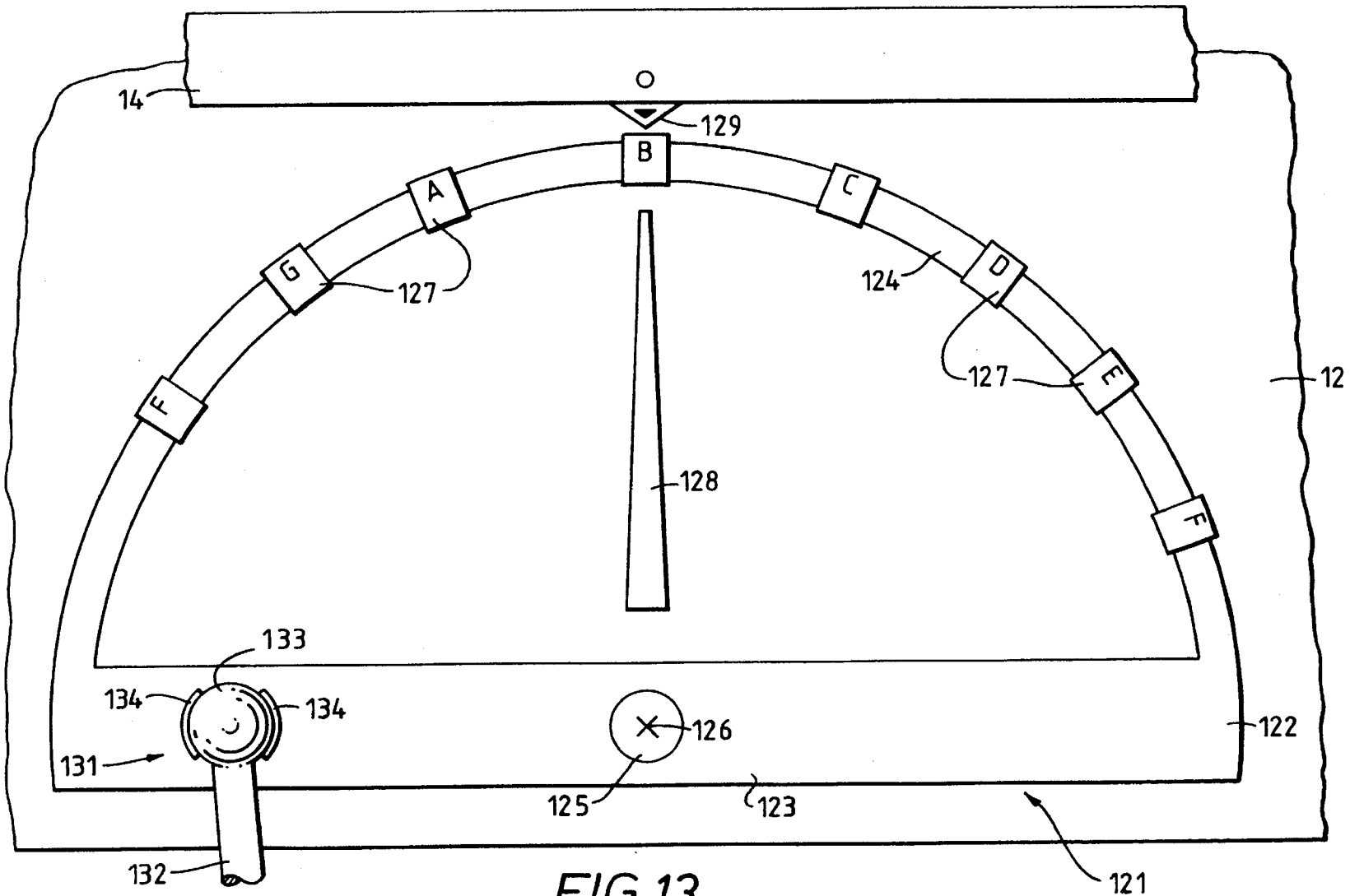
FIG. 13 shows an alternative form of drum gauge.

FIG. 13 shows another form of gauge 121. The gauge 121 comprises a scale part 122 of hollow, semi-circular shape, having a diametrical side 123 and a curved side 124. The scale member has a pivotal connection 125 at the centre of its diametrical side for mounting it on a drum so that it is pivotable about an axis 126. The scale member 122 carries indicating members 127 around its curved part, these indicating members bearing the letters of a musical scale. The indicating members are normally fixed relative to the scale member but can be moved for calibration purposes. The gauge includes a fixed pointer 128 or indicator 129 against which the scale member will move. Adjacent one side, the scale member carries one part of a universal coupling joint 131 for coupling the scale member to a rigid rod 132. The universal joint comprises a sphere 133 integral with the end of the rod and a bracket attached to the scale member and having two spaced arms 134 having part spherical internal surfaces, adapted to closely engage the outer surface of the sphere 133. The arms are sufficiently flexible that the sphere can be pushed between them or pulled out for easy coupling and de-coupling of the rod. The other end of the rod is attached to the lever 42 of the tuning system by a similar universal bearing. The rod 132 therefore acts as a rigid, easily detached, coupling member between the scale member and the tuning lever.

What is claimed is:

1. A timpano type drum having a head, a cylindrical shell attached to and extending downwardly from the head, the shell having an open bottom, a plurality of tension bolts attached to the head, the drum head and shell being symmetrical about a drum axis, a stand which is movable between a folded relatively flat condition and an erect three dimensional support position in which it is adapted to be connected to and support the shell and head with the drum axis substantially vertical, fastening means for attaching and detaching the stand to and from the shell, foot operated tuning means having an upper part fixed to the shell and to the tension bolts, and a lower part fixed to the stand, and coupling means for detachably coupling the upper and lower parts together in the erect condition of the stand with the head and shell supported thereon, such that movement of the lower part of the tuning means will adjust the tuning of the head via the tension bolts.

2. A drum according to claim 1 in which the depth of the shell is no more than 70 cms, and the upper part of the tuning means is located within the depth of the shell.

3. A drum according to claim 2 in which the depth of the shell is no more than 50 cms.

4. A drum according to claim 2 in which the upper part of the tuning means comprises a plurality of rods extending substantially radially within the shell and having outer ends effectively connected to the tension bolts and inner ends effectively connected to a common member adapted to be acted on by the coupling means such that upward movement of the common member causes downward movement of the tension bolts to increase the tension of the head by a lever action.

5. A drum according to claim 4 in which the tuning means is a lever system having a mechanical advantage greater than 10.

6. A drum according to claim 4 in which the lower part of the tuning means comprises a lower lever member pivotable about a horizontal axis, a free end of the lower lever member carrying a foot pedal and another end being coupled to a lower end of the coupling means.

7. A drum according to claim 6 including brake means comprising a spring loaded brake member carried by the lower lever member for frictional engagement with the guide member.

8. A drum according to claim 6 in which the brake member is movable between an on position and an off position by movement of the foot pedal on the lower lever member.

9. A drum according to claim 1 in which the tuning means comprises a system of levers connecting a foot pedal on the lower part of the tuning system to the tension bolts on the head of the drum, the lever system having a mechanical advantage greater than 10.

10. A drum according to claim 9 in which the lower part of the tuning means comprises a lower lever member pivotable about a horizontal axis, a free end of the lower lever member carrying a foot pedal and another end being coupled to a lower end of the coupling means.

11. A drum according to claim 10 including brake means comprising a spring loaded brake member carried by the lower lever member for frictional engagement with the guide member.

12. A drum according to claim 1 in which the coupling means is a central rod adapted to move up and down on the drum axis, the upper part of the tuning means is in the form of a plurality of arms extending substantially radially of the drum axis and mounted in the shell, each arm having an outer end effectively connected to a tension bolt and an inner end coupled to the rod, such that movement of the central rod upwards moves the tension bolts downwards by lever action to tension the drum head.

13. A drum according to claim 12 in which the lower part of the tuning means comprises a lower lever member pivotable about a horizontal axis, a free end of the lower lever member carrying a foot pedal and another end being coupled to a lower end of the coupling means.

14. A drum according to claim 3 in which the lower lever member is guided in its pivotal movement by an upright arcuate guide member.

15. A drum according to claim 13 including brake means comprising a spring loaded brake member carried by the lower lever member for frictional engagement with the guide member.

16. A drum according to claim 1 including retaining means for retaining the tuning means in an adjusted position, said retaining means comprising solely a spring loaded brake member carried on a movable part of the lower part of the tuning means for frictional engagement with a fixed member.

17. A drum according to claim 1 in which the foldable stand comprises two sides pivotably connected adjacent a base of the stand for relative movement about a horizontal axis, the sides being movable between a folded condition adjacent one another and an erect condition extending at an angle less then 90° to one another.

18. A drum according to claim 1 in which the stand includes a base support, a chassis extending upwardly from the base support, a block slidable on the chassis, legs pivotably connected to the block and linkage means connecting the legs with rods forming parts of sides of the stand, such that the legs, rods and block form a symmetrical parallel linkage about a central plane of the drum, such that movement up and down of the block moves the stand between the folded and erect positions.

19. A drum having a head, a plurality of tension bolts connected to the head for tensioning the head, a shell connected to the head and extending downwardly therefrom and having an open bottom, the head and shell being symmetrical about a drum axis, a foot operating tuning means arranged for tuning the head via the tension bolts, in which the tuning means comprises a plurality of substantially horizontally and radially extending arms located within the depth of the shell, the arms having outer ends effectively connected to respective ones of the tension bolts and inner ends adjacent one another and arranged to be operated on by a common operating rod substantially on the drum axis, the arrangement being such that movement of this central rod upwards moves the tension bolts downwards by a lever action to increase the tension on the drum head, and foot operated means for moving the common operating rod.

20. A drum according to claim 19 in which the foot operated means is a lower lever member pivotable about a horizontal axis, a free end of the lever member carrying a foot pedal and another end being coupled to a lower end of the rod.

21. A drum according to claim 20 together with a stand therefor and including brake means comprising a spring loaded brake member carried by the lower lever member for frictional engagement with the guide member.

22. In combination a drum having a moveable tuning means and a gauge for indicating how the drum is tuned comprising a scale member having a curved side with indicating members spaced therealong, pivotable mounting means mounting the scale member to the drum, so that the scale member can move against a fixed indicator substantially aligned with the pivotable mounting means, a rigid rod external of the drum, and a substantially universal connection joint at each end of the rod detachably connecting the rod between the tuning member and the scale member.

* * * * *